US007628159B2

(12) United States Patent
De Laforcade

(10) Patent No.: US 7,628,159 B2
(45) Date of Patent: Dec. 8, 2009

(54) DEVICE FOR TREATING THE HAIR AND METHOD OF USING SUCH A DEVICE

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 893 days.

(21) Appl. No.: 10/840,371

(22) Filed: May 7, 2004

(65) Prior Publication Data

US 2004/0221862 A1 Nov. 11, 2004

Related U.S. Application Data

(60) Provisional application No. 60/472,463, filed on May 22, 2003.

(30) Foreign Application Priority Data

May 7, 2003 (FR) ..... 03 05557

(51) Int. Cl.
*A45D 24/22* (2006.01)

(52) U.S. Cl. ..... 132/112

(58) Field of Classification Search ..... 132/111–116, 132/126, 124; D28/7; 401/196, 268
See application file for complete search history.

(56) References Cited

U.S. PATENT DOCUMENTS

| | | | | |
|---|---|---|---|---|
| 2,618,275 A * | 11/1952 | Pearson | ..... | 132/112 |
| 3,523,630 A | 8/1970 | Catapano | | |
| 4,209,027 A * | 6/1980 | Morganroth | ..... | 132/212 |
| 4,691,720 A | 9/1987 | Schmitz | | |
| 4,858,792 A | 8/1989 | de Laforcade | | |
| 5,772,077 A | 6/1998 | Tafur | | |
| 5,848,598 A | 12/1998 | Walz et al. | | |
| 5,915,390 A * | 6/1999 | Daughtry | ..... | 132/112 |
| 6,000,405 A * | 12/1999 | De Laforcade | ..... | 132/116 |
| 6,062,230 A * | 5/2000 | Kajgana | ..... | 132/116 |
| 6,637,440 B2 * | 10/2003 | de Laforcade | ..... | 132/112 |

FOREIGN PATENT DOCUMENTS

| | | |
|---|---|---|
| DE | 85 19 968 | 10/1985 |
| DE | 37 44 440 | 12/1987 |
| DE | 100 16 431 | 10/2001 |
| FR | 2 805 442 | 8/2001 |
| FR | 2 828 999 | 3/2003 |
| GB | 2 161 401 | 1/1986 |
| JP | 2002165630 | 6/2002 |

* cited by examiner

*Primary Examiner*—Robyn Doan
(74) *Attorney, Agent, or Firm*—Oliff & Berridge, PLC

(57) ABSTRACT

Embodiments of a device for treating the hair includes: a receptacle containing a substance to be applied to at least one of the hair and the scalp; a lifter member for lifting the hair and comprising a comb secured to the receptacle and movable relative thereto; and at least one dispenser endpiece for dispensing the substance on at least one of the hair and the scalp after the hair has been lifted by the lifter member.

31 Claims, 2 Drawing Sheets

DEVICE FOR TREATING THE HAIR AND METHOD OF USING SUCH A DEVICE

CROSS-REFERENCE TO RELATED APPLICATIONS

This non provisional application claims the benefit of French Application No. 03 05557 filed on May 7, 2003, and U.S. Provisional Application No. 60/472,463 filed on May 22, 2003, the entire disclosure of which is incorporated by reference herein.

FIELD OF INVENTION

The present invention relates to devices and methods for treating the hair, and more particularly hair roots.

BACKGROUND

Devices for applying substance to the hair are known from French patent documents FR-A-2,828,999 and FR-A-2,805,442.

SUMMARY OF THE INVENTION

Exemplary embodiments of the present invention provide devices and methods that give volume to the hair, for example, by applying substance to hair roots that hardens as the substance dries so as to cause the hair roots to be more upstanding on the scalp.

In various exemplary embodiments, the invention provides a novel device that enables such a substance to be applied.

In various exemplary embodiments, the invention provides a device comprising: a receptacle containing a substance for application to at least one of the hair and the scalp; a lifter member for lifting the hair, the lifter member being secured to the receptacle and movable relative thereto; and at least one dispenser endpiece for dispensing the substance on at least one of the hair and the scalp, after the hair has been lifted by the lifter member.

Various exemplary embodiments of the invention allow a user to easily apply a substance to the hair for the purpose of stiffening the root ends thereof while the hairs are upstanding on the scalp, thereby obtaining a desired volume effect.

Since the lifter member that lifts the hair is secured to the receptacle, in such embodiments the device is advantageously made in such a manner as to enable the user to actuate the lifter member using a same hand as is being used to hold the receptacle. Thus, the other hand of the user remains available, for example, for helping to obtain a desired hairstyle.

In exemplary embodiments, the receptacle preferably includes a substance dispenser valve which is actuated by moving the lifter member. This makes the device simpler to use.

Further, in exemplary embodiments, the device preferably includes a dispenser endpiece distinct from the lifter member. This makes it possible, for example, to spray substance in a direction substantially perpendicular to a portion of the hair that extends between the scalp and the lifter member.

In exemplary embodiments, the lifter member advantageously comprises a comb, for example, having at least one row of teeth, or indeed a single row of teeth. The teeth may have bases that are in alignment. For example, the comb may comprise two to forty teeth. Further, the comb may comprise five to twenty teeth. Free ends of the teeth may point in a direction that is substantially away from the receptacle, particularly while the lifter member is being actuated.

In exemplary embodiments, the hair lifter member may advantageously include an actuator portion defining a location on which the user can press in order to cause the lifter member to move relative to the receptacle.

In exemplary embodiments, the lifter member may be connected via at least one tab to a base portion fastened on the receptacle. The tab may include at least one film-hinge. For example, the lifter member may include two such tabs, each provided with a film-hinge and spaced apart from each other sufficiently to enable the dispenser endpiece to engage therebetween while dispensing the substance, after the lifter member has been moved to lift the hair.

In exemplary embodiments, the device may also include a portion for bearing against the scalp, which portion may be stationary relative to the receptacle. The bearing portion may rest on the scalp while the lifter member is being moved to lift the hair. The bearing portion may comprise, for example, two rods which may be parallel and situated at equal distances from the dispenser endpiece. For example, the rods may be of a length that is selected so that free ends thereof are at substantially a same level as the bases of the teeth of the comb, prior to the lifter member being actuated, and when the device is observed in a direction perpendicular to a longitudinal axis of the receptacle.

In exemplary embodiments, the dispenser endpiece may include an abutment against which the lifter member can bear at an end of displacement thereof. The abutment can come into contact, for example, with the actuator portion of the lifter member.

In exemplary embodiments, the dispenser endpiece may be connected to the base portion via at least one film-hinge, and the abutment may be situated on a side of the dispenser valve that is opposite from the film-hinge.

The dispenser endpiece may be provided with a nozzle arranged to generate a spray.

The substance contained in the receptacle may contain polymers and may have a drying time that is relatively short, for example, less than 30 seconds.

Exemplary embodiments of the present invention provide a device for treating the hair, the device comprising: a receptacle containing a substance for application to at least one of the hair and the scalp; a lifter member for lifting the hair, the lifter member comprising a comb secured to the receptacle and movable relative thereto; and at least one dispenser endpiece for dispensing the substance on at least one of the hair and the scalp, after the hair has been lifted by the lifter member.

In exemplary embodiments, the comb may comprise at least one row of teeth, for example, a row of two to forty teeth. Free ends of the teeth may point in a direction going substantially away from the receptacle, for example, while the lifter member is being actuated.

Exemplary embodiments of the present invention provide a hair treatment device comprising: a receptacle containing a substance for application to at least one of the hair and the scalp, and including a substance dispenser valve; a lifter member for lifting the hair, the lifter member being secured to the receptacle and movable relative thereto, movement of the lifter member enabling the substance dispenser valve to be actuated; and at least one dispenser endpiece for dispensing the substance onto at least one of the hair and the scalp, after the hair has been lifted by the lifter member.

Exemplary embodiments of the present invention provide a hair treatment device comprising: a receptacle containing a substance for application to at least one of the hair and the scalp; a hair-lifter member secured to the receptacle and movable relative thereto; and at least one dispenser endpiece for dispensing the substance on at least one of the hair and the scalp, after the hair has been lifted by the hair-lifter member; the hair-lifter member being connected via at least one film-hinge to a base portion that is fastened to the receptacle.

In exemplary embodiments, the hair-lifter member may be connected to the base portion via at least one tab, for example, two tabs, each provided with a respective film-hinge, the tabs being spaced apart from each other sufficiently to allow the dispenser endpiece to engage therebetween while dispensing the substance, after the hair-lifter member has been displaced to lift the hair.

Exemplary embodiments of the present invention provide a method of applying a substance to the hair, the method comprising: providing a device as defined above; lifting the hair with the hair-lifter member; and dispensing a substance onto the roots of the hair when lifted.

After the substance has been dispensed, the hair can be held in a desired lifted position for a length of time that is sufficient to allow the substance to dry.

BRIEF DESCRIPTION OF THE DRAWINGS

The invention can be better understood on reading the following detailed description of non-limiting embodiments thereof, and on examining the accompanying drawings, in which.

DETAILED DESCRIPTION OF EXEMPLARY EMBODIMENTS

Figure 1:
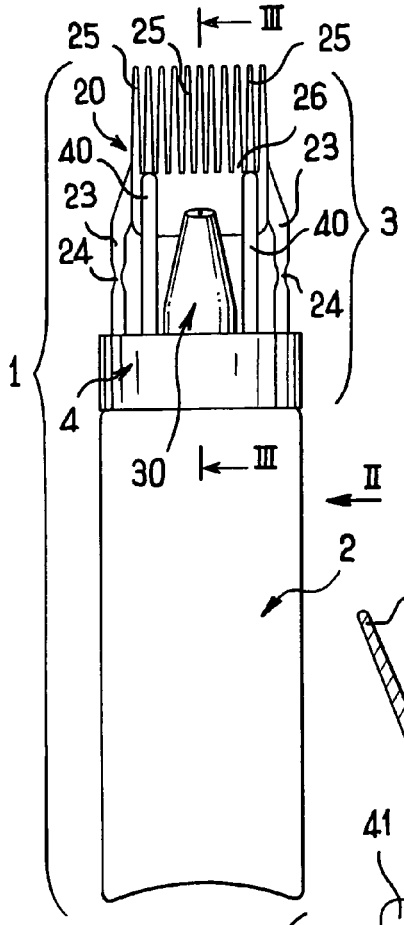
FIG. 1 is a diagrammatic elevation view showing a device according to an exemplary embodiment of the invention.
Figure 3:
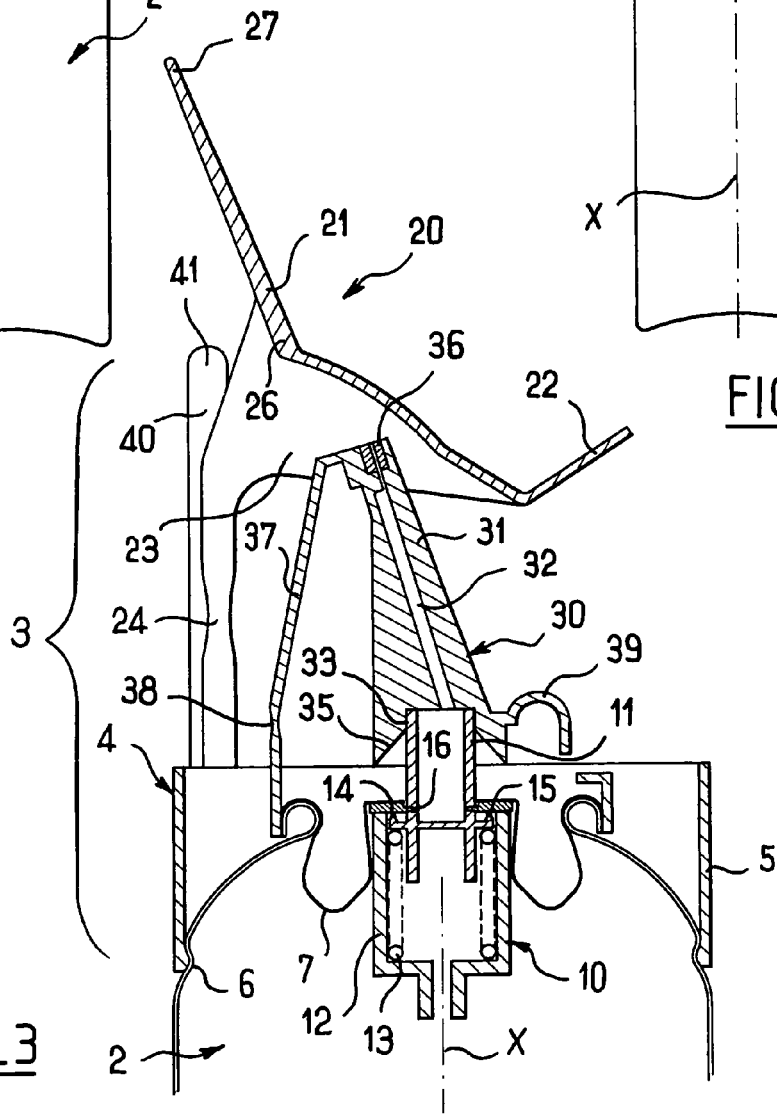
FIG. 3 is a diagrammatic and fragmentary axial section view of the exemplary device taken along line III-III of FIG. 1.

FIG. 1 show a device 1 comprising a receptacle 2 containing a substance pressurized by a propellant gas, for example, a substance rich in polymers and suitable for drying quickly, together with a dispenser head 3 fastened on the receptacle 2 via a base portion 4. As shown in FIG. 3, the base portion 4 may comprise an assembly skirt 5 snap-fastened in an annular groove 6 near a top of the receptacle 2. In the exemplary embodiment shown, the receptacle 2 includes a cup 7 that supports a dispenser valve 8, the cup 7 being crimped to the body of the receptacle 2.

In a conventional manner, the dispenser valve 10 may comprise a hollow control rod 11, a body 12 held by the cup 7 and into which the rod 11 can be depressed, and a spring 13 for returning the rod 11 into a position in which the rod 11 bears via a sealing lip 14 against an annular gasket 15. In this position, the lip 14 closes off communication between an inside of the body 12 and a lateral orifice 16 of the rod 11, through which orifice 16 the substance can flow from the receptacle 2 when the rod 11 is depressed.

In embodiments of the invention, the dispenser head 3 also comprises a hair-lifter member 20 and a dispenser endpiece 30.

The hair-lifter member 20 may comprise a comb 21 and an actuator portion 22 against which a user can press to move the comb 21, thereby lifting the comb 21.

In the exemplary embodiment shown, the comb 21 and the actuator portion 22 are made integrally by molding a plastics material, together with two tabs 23 that connect to the base portion 4, each having a thin portion 24 defining a film-hinge, thereby enabling the comb 21 and the actuator portion 22 to pivot about an axis perpendicular to the plane of FIG. 3 and to a longitudinal axis X of the receptacle 2 when the user presses on the actuator portion 22. The base portion 4 may be made integrally, i.e., monolithically, with the tabs 23. It should be understood that the thin portion 24 may be replaced by any other suitable hinge means, either known or hereafter developed.

In the exemplary embodiment shown, the comb 21 comprises a row of teeth 25 having bases 26 that are in alignment, and free ends 27 of the teeth 25 that are directed generally away from the receptacle 2.

The dispenser endpiece 30 and the comb 21 are offset along the axis X. Further, the endpiece 30 comprises a body 31 of generally frustoconical shape, in the exemplary embodiment shown, provided with an internal channel 32 whose bottom end opens into a housing 33 that receives an end of the control rod 11. The house 33 is extended downward by a cone 35 that facilitates insertion of the rod 11.

The body 31 of the dispenser endpiece 30 receives a nozzle 36 at a top end thereof and is connected to the base portion 4 by a tab 37 made integrally, i.e., monolithically, with the body 31, the tab 37 including a thin zone 38 defining a film-hinge. Thus, the body 31 and the dispenser endpiece 30 can pivot about an axis that is substantially parallel to the axis about which the lifter member 20 can tilt. The tabs 37 can be made integrally, i.e., monolithically, with the base portion 4. As sown in FIG. 3, the thin zones 24 and 38 are situated on a same side of the device 1 relative to the axis of the control rod 11, which coincides with the axis X.

Figure 4:
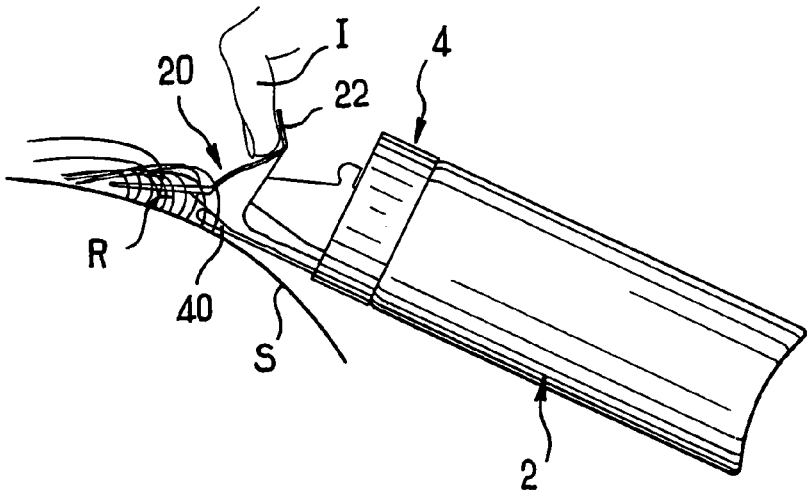
FIGS. 4 to 6 illustrate the exemplary device of FIGS. 1 to 3 in use for giving volume to the hair.
Figure 5:
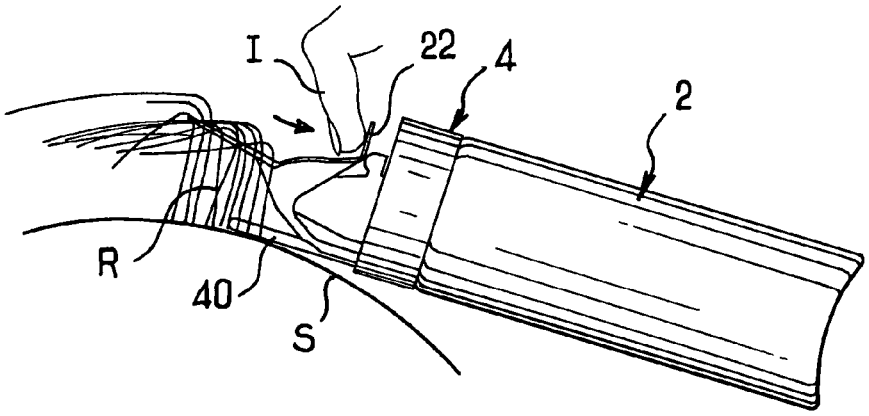
Figure 6:
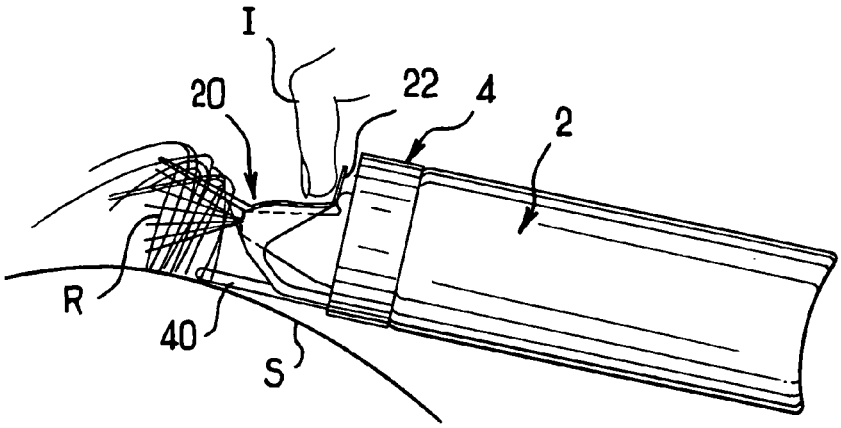

On a side remote from the tab 37, the dispenser endpiece 30 is made to have an abutment 39 against which the actuator portion 22 can come to bear when the user presses thereon, for example, with an index finger I, as shown in FIGS. 4 to 6.

In the exemplary embodiment shown, the device 1 further comprises two rods 40 that extend parallel to the longitudinal axis X of the receptacle 2 and are connected to the base portion 4 in a vicinity of the assembly skirt 5.

Free ends 41 of the rods 40 are rounded in shape and are situated substantially at a same level as the bases 26 of the teeth prior to the hair-lifter member 20 being actuated, as shown in FIG. 3.

The device 1 may be used as follows.

A user takes hold of the receptacle 2 in one hand, placing the index finger I on the actuator portion 22, and slides the comb 21 tangentially to the scalp S so as to select a portion of the hair that is to be made to stand up, as shown in FIG. 4. The user can take advantage of the rods 40 which bear against the scalp S.

Once the device 1 is in place, the user can press on the actuator portion 22 until the actuator portion 22 comes into abutment with the abutment 39 on the dispenser endpiece 30.

The pressure exerted by the index finger I lifts the comb 21 so that the comb 21 takes up an angle relative to an initial orientation of the comb 21. The hair-lifter member 20 is made somewhat easier to move by the presence of the rods 40.

The hair taken between the teeth 25 of the comb 21 follows the movement so the roots R of the hair extend in a direction substantially perpendicular to the scalp S, thereby exposing the hairs for subsequent operations, as shown in FIG. 5.

By pressing a little harder on the actuator portion 22, the abutment 39 of the dispenser endpiece 30 is caused to move, thereby entraining the control rod 11 and opening the dispenser valve 10, thus causing the spray to be released. The spray is deposited directly on the roots of the hair, between the scalp S and the portion of the hair that is engaged in the comb 21, as shown in FIG. 6.

Once the desired quantity of substance has been deposited, the user can relax the pressure applied to the actuator portion 22 a little so as to cause dispensing of the substance to stop.

Figure 2:
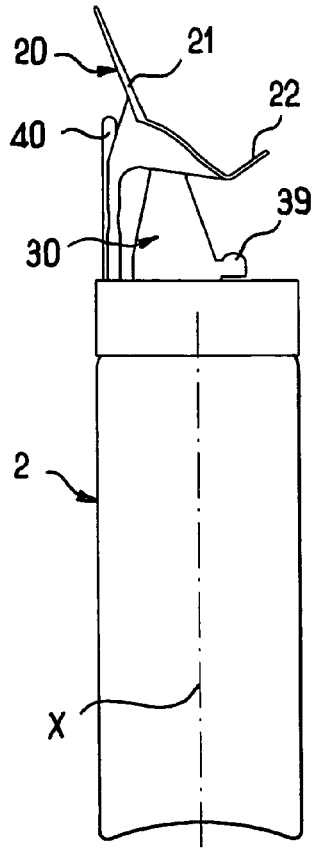
FIG. 2 is a side view of the exemplary device as seen looking along arrow II of FIG. 1.

The user can hold the hair-lifter member 20 in this intermediate position for a length of time needed to allow the substance to dry, thus enabling the roots R to be fixed in a desired position so as to give the hair a desired volume. When the user releases the actuator portion 20, the actuator portion can return to the initial position shown in FIG. 2, for example, because the thin zones 24 possess a certain amount of shape memory.

Naturally, the invention is not limited to the exemplary embodiment described above.

Exemplary embodiments of the invention contemplate that the shape of the hair-lifter member can be modified. For example, it is possible to use hair-holding elements of some other form. It is also possible to modify the shape of the dispenser endpiece and the shape of the actuator portion, amongst other possible modifications. Where appropriate, the hinge of the hair-lifter member and/or the means for possible return thereof to the initial position can be provided other than by a film-hinge.

Throughout the description, including in the claims, the term "comprising a" should be understood as being synonymous with "comprising at least one," unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for treating the hair, the device comprising:

a receptacle containing a substance for application to at least one of the hair and the scalp;

a lifter member for lifting the hair, the lifter member comprising a comb secured to the receptacle and movable relative thereto; and at least one dispenser endpiece for dispensing the substance on at least one of the hair and the scalp, after the hair has been lifted by the lifter member, wherein the dispenser endpiece is distinct from the lifter member, wherein the lifter member and the dispenser endpiece are articulated relative to the receptacle independently from each other, and the dispenser endpiece is connected to a base portion via at least one film-hinge.

2. A device according to claim 1, wherein the abutment is situated on a side of a dispenser valve that is opposite from the film-hinge.

3. A device for treating the hair, the device comprising:

a receptacle containing a substance for application to at least one of the hair and the scalp, and including a substance dispenser valve;

a lifter member for lifting the hair, the lifter member being secured to the receptacle and movable relative thereto, movement of the lifter member enabling the substance dispenser valve to be actuated; and at least one dispenser endpiece for dispensing the substance onto at least one of the hair and the scalp, after the hair has been lifted by the lifter member, wherein the movement of the lifter member relative to the receptacle between an initial and an intermediate position lifts the hair without dispensing substance and the movement of the lifter member beyond said intermediate position causes the substance to be dispensed.

4. A device according to claim 3, the device being arranged to enable a user to actuate the lifter member with a same hand as being used to hold the receptacle.

5. A device according to claim 3, wherein the dispenser endpiece is distinct from the lifter member.

6. A device according to claim 3, wherein the lifter member includes a comb.

7. A device according to claim 6, wherein the comb comprises at least one row of teeth.

8. A device according to claim 7, wherein the comb comprises two to forty teeth.

9. A device according to claim 7, wherein free ends of the teeth point substantially away from the receptacle.

10. A device according to claim 3, wherein the lifter member comprises a comb having teeth and free ends of the teeth point substantially away from the receptacle while the lifter member is being actuated.

11. A device according to claim 3, wherein the lifter member includes an actuator portion defining a location on which a user can press in order to cause the lifter member to move relative to the receptacle.

12. A device according to claim 3, including a bearing portion for bearing against the scalp, said bearing portion being stationary relative to the receptacle.

13. A device according to claim 12, wherein the bearing portion comprises two rods.

14. A device according to claim 13, wherein the rods are parallel and situated at equal distances from the dispenser endpiece.

15. A device according to claim 13, wherein the lifter member includes a comb comprising teeth and the rods are of a length that is selected so that free ends thereof are situated substantially at a same level as bases of the teeth of the comb, prior to the lifter member being actuated, and when the receptacle is observed in a direction perpendicular to a longitudinal direction of the receptacle.

16. A device according to claim 3, wherein the dispenser endpiece includes an abutment against which the lifter member comes to bear at an end of movement thereof.

17. A device according to claim 3, wherein the dispenser endpiece is connected to a base portion via at least one film-hinge.

18. A device according to claim 16, wherein the abutment is situated on a side of the dispenser valve that is opposite from a film-hinge.

19. A device according to claim 3, wherein the dispenser endpiece is provided with a nozzle arranged to generate a spray.

20. A device according to claim 3, wherein the substance contained in the receptacle contains polymers and has a drying time of less than thirty seconds.

21. A method of applying a substance on the hair, the method comprising:

providing a device as defined in claim 3;

lifting the hair with the lifter member; and dispensing a substance on the roots of the hair when lifted with the lifter member.

22. A method according to claim 21, wherein, after the substance has been dispensed, the hair is held lifted for a length of time that is sufficient to allow the substance to dry.

23. A device for treating the hair, the device comprising:

a receptacle containing a substance for application to at least one of the hair and the scalp;

a lifter member for lifting the hair, the lifter member being secured to the receptacle and movable relative thereto;

at least one dispenser endpiece enabling dispensing of the substance on at least one of the hair and the scalp only after the hair has been lifted by the movement of rotation of the lifter member relative to the receptacle, and the lifter member being connected via at least one film-hinge defining an axis of rotation to a base portion that is fastened to the receptacle, wherein the dispenser endpiece is distinct from the lifter member.

24. A device for treating the hair, the device comprising:

a receptacle containing a substance for application to at least one of the hair and the scalp;

a lifter member for lifting the hair, the lifter member being secured to the receptacle and movable relative thereto;

at least one dispenser endpiece enabling dispensing of the substance on at least one of the hair and the scalp only after the hair has been lifted by the movement of rotation of the lifter member relative to the receptacle, and the lifter member being connected via at least one film-hinge defining an axis of rotation to a base portion that is fastened to the receptacle, wherein the lifter member includes an actuator portion defining a location on which the user can press in order to cause the lifter member to move relative to the receptacle.

25. A device for treating the hair, the device comprising:

a receptacle containing a substance for application to at least one of the hair and the scalp;

a lifter member for lifting the hair, the lifter member being secured to the receptacle and movable relative thereto;

at least one dispenser endpiece enabling dispensing of the substance on at least one of the hair and the scalp only after the hair has been lifted by the movement of rotation of the lifter member relative to the receptacle, and the lifter member being connected via at least one film-hinge defining an axis of rotation to a base portion that is fastened to the receptacle, wherein the device includes a bearing portion for bearing against the scalp, said bearing portion being stationary relative to the receptacle, and the bearing portion comprises two rods.

26. A device according to claim 25, wherein the rods are parallel and are situated at equal distances from the dispenser endpiece.

27. A device according to claim 25, wherein the lifter member includes a comb comprising teeth and the rods are of a length that is selected so that free ends thereof are situated substantially at a same level as bases of the teeth of the comb, prior to the lifter member being actuated, and when the receptacle is observed in a direction perpendicular to a longitudinal axis of the receptacle.

28. A device for treating the hair, the device comprising:

a receptacle containing a substance for application to at least one of the hair and the scalp;

a lifter member for lifting the hair, the lifter member being secured to the receptacle and movable relative thereto;

at least one dispenser endpiece enabling dispensing of the substance on at least one of the hair and the scalp only after the hair has been lifted by the movement of rotation of the lifter member relative to the receptacle, and the lifter member being connected via at least one film-hinge defining an axis of rotation to a base portion that is fastened to the receptacle, wherein the dispenser endpiece includes an abutment against which the lifter member comes to bear at an end of movement thereof, and the abutment is situated on the side of the dispenser valve that is opposite from the film-hinge.

29. A device for treating the hair, the device comprising:

a receptacle containing a substance for application to at least one of the hair and the scalp;

a lifter member for lifting the hair, the lifter member comprising a comb secured to the receptacle and movable relative thereto; and at least one dispenser endpiece for dispensing the substance on at least one of the hair and the scalp, after the hair has been lifted by the lifter member, wherein the lifter member is connected via at least one tab to a base portion fastened to the receptacle, and wherein the tab includes at least one film-hinge, wherein the at least one tab comprises two tabs, each being provided with a film-hinge, the two tabs being spaced apart from each other sufficiently to enable the dispenser endpiece to engage therebetween while dispensing the substance, after the lifter member has been moved to lift the hair.

30. A device for treating the hair, the device comprising:

a receptacle containing a substance for application to at least one of the hair and the scalp, and including a substance dispenser valve;

a lifter member for lifting the hair, the lifter member being secured to the receptacle and movable relative thereto, movement of the lifter member enabling the substance dispenser valve to be actuated; and at least one dispenser endpiece for dispensing the substance onto at least one of the hair and the scalp, after the hair has been lifted by the lifter member, wherein the lifter member is connected via at least one tab to a base portion fastened to the receptacle, and wherein the tab includes at least one film-hinge, wherein the at least one tab comprises two tabs, each being provided with a film-hinge, the two tabs being spaced apart from each other sufficiently to enable the dispenser endpiece to engage therebetween while dispensing the substance, after the lifter member has been moved to lift the hair.

31. A device for treating the hair, the device comprising:

a receptacle containing a substance for application to at least one of the hair and the scalp;

a lifter member for lifting the hair, the lifter member being secured to the receptacle and movable relative thereto;

at least one dispenser endpiece for dispensing the substance on at least one of the hair and the scalp after the hair has been lifted by the lifter member;

the lifter member being connected via at least one film-hinge to a base portion that is fastened to the receptacle, wherein the film-hinge includes two tabs each provided with a film-hinge whereby the lifter member is connected to the base portion, said tabs being spaced apart from each other sufficiently to allow the dispenser endpiece to engage therebetween while dispensing the substance, after the lifter member has been moved to lift the hair.

* * * * *